United States Patent [19]

Ishida et al.

[11] 4,165,585

[45] Aug. 28, 1979

[54] AUTOMATIC DOFFING AND DONNING APPARATUS

[75] Inventors: Kinyu Ishida, Takatsuki; Kumaichi Fukumoto, Sakai, both of Japan

[73] Assignee: Teijin Limited, Osaka, Japan

[21] Appl. No.: 881,145

[22] Filed: Feb. 27, 1978

[30] Foreign Application Priority Data

Jun. 3, 1977 [JP] Japan ..... 52/64622

[51] Int. Cl.[2] ..... D01H 9/08

[52] U.S. Cl. ..... 57/268; 57/274; 57/275

[58] Field of Search ..... 57/52, 53, 54, 156, 57/266, 267, 268, 270–277

[56] References Cited

U.S. PATENT DOCUMENTS

| | | | |
|---|---|---|---|
| 3,307,340 | 3/1967 | Nishi et al. | 57/53 |
| 3,566,597 | 3/1971 | Para | 57/53 |
| 3,681,906 | 8/1972 | Burgemeister et al. | 57/156 X |
| 3,791,123 | 2/1974 | Kawauchi | 57/156 X |
| 3,844,099 | 10/1974 | Tsuchiyama et al. | 57/53 |
| 4,081,949 | 4/1978 | Keller et al. | 57/53 |

*Primary Examiner*—Donald Watkins
*Attorney, Agent, or Firm*—Burgess, Ryan and Wayne

[57] ABSTRACT

An automatic doffing and donning apparatus is disclosed for replacing a plurality of full bobbins which are mounted on winding spindles disposed parallel to each other on a yarn processing machine with a plurality of empty bobbins which are mounted on a bobbin reservoir plate disposed along and in front of the winding spindles. The apparatus comprises: a movable frame which is horizontally movable along both the yarn processing machine and the bobbin reservoir plates; a full bobbin doffing device mounted on the movable frame for doffing the full bobbins formed on the winding spindles and transferring them to the bobbin reservoir plate, and; an empty bobbin donning device mounted on the movable frame. The empty bobbin donning device is provided with: an empty bobbin transfer mechanism which moves the empty bobbins on the bobbin reservoir plates to a stand-by position located vertically outside of the operating space of the full bobbin doffing device, so that the empty bobbins do not disturb the operation of the full bobbin doffing device, and; a bobbin insert mechanism which receives the empty bobbins from the empty bobbin transfer mechanism located at the stand-by position and which inserts them on the winding spindles after the full bobbins are doffed from the winding spindles by the full bobbin doffing device.

17 Claims, 24 Drawing Figures

300
400
80
60
40
K
L
M
H
XII

AUTOMATIC DOFFING AND DONNING APPARATUS

BACKGROUND OF THE INVENTION

This invention relates to an automatic doffing apparatus for doffing full bobbins formed on winding spindles which are disposed parallel to each other on a yarn; processing machine, such as a draw-twister for synthetic yarn and a melt spinning machine for synthetic yarn, more especially, the present invention relates to an automatic doffing and donning apparatus for replacing full bobbins formed on winding spindles with empty bobbins.

In the modern manufacturing process of synthetic yarn packages, since the weight of individual full bobbins is rapidly increasing so as to increase productivity, manual handling of such a full bobbin becomes troublesome. On the other hand, since the yarn processing speed is increased, the frequency of the replacement of full bobbins with empty bobbins, in other words the doffing and donning operations, is increased. Due to the increases in the weight of individual full bobbins and the frequency of the doffing and donning operations, manual handling of full bobbins becomes very difficult. To obviate the above-mentioned difficulty the requirement for an automatic doffing and donning apparatus is increasing.

Various types of automatic doffing and donning apparatus have been proposed, which can be classified into two types. One is a fixed-type doffing and donning apparatus which is connected to a yarn processing machine and which simultaneously can doff all full bobbins formed on winding spindles of the yarn processing machine. The other is a movable type doffing and donning apparatus which can move in front of a yarn processing apparatus and which can doff a predetermined number of full bobbins from winding spindles of the yarn processing machine.

Since the fixed type doffing and donning apparatus is disposed on each yarn processing machine, the cost of the equipment of the fixed type doffing and donning apparatus may be higher than that of the movable type doffing and donning apparatus when a plurality of yarn processing machines is provided with doffing and donning apparatus. Furthermore, the operating efficiency of the fixed type doffing and donning apparatus is lower than that of the movable type doffing apparatus. In addition, since the fixed type doffing apparatus is permanently mounted on a yarn processing machine and is located in an aisle between two adjacent yarn processing machines, the distance between the adjacent two yarn processing machines must be increased to ensure an operational space for operators. However, in a conventional yarn processing mill, since the width of the aisle, in other words the distance between two adjacent yarn processing machines, has been designed to be narrow so as to allow installation of more machines in a mill, operations performed by operators around the conventional yarn processing machine may be disturbed by the provision of the fixed type doffing and donning apparatus.

Accordingly, the movable type doffing and donning apparatus is superior to the fixed type doffing and donning apparatus. A movable type doffing apparatus is disclosed in Japanese Published Patent Application Sho 50-10970. The disclosed apparatus carries a number of empty bobbins at an upper portion thereof and receives a number of full bobbins which are doffed thereby from a yarn processing machine at a lower portion thereof by means of a doffing means. Thereafter the empty bobbins which are carried thereon are donned on winding spindles of the yarn processing machine. It is necessary for the above-mentioned doffing and donning apparatus to be moved to a predetermined unloading position, which is far from the yarn processing machine, after a predetermined number of full bobbins are doffed so that the full bobbins can be unloaded from the apparatus and empty bobbins can be loaded on the apparatus. A great amount of operating time is consumed in the movement to the unloading position and, as a result, the doffing and donning apparatus is not fully used. Accordingly, although the equipment cost of the doffing and donning apparatus is very high, the operating efficiency of the doffing and donning apparatus is low. In addition, since full bobbins doffed by the doffing apparatus and empty bobbins donned by the doffing apparatus, the sizes of which bobbins are recently increasing, are carried on the doffing and donning apparatus, the size and the weight of the doffing apparatus becomes large. As a result, a wide space for installation of the large doffing and donning apparatus and a strong floor construction for bearing the weighty doffing and donning apparatus are necessary, and the total cost of the mill becomes high. On the other hand, when the doffing and donning apparatus is installed in a conventional yarn processing mill, alteration of the mill for meeting the above-mentioned requirements with regard to the space and the floor construction is necessary. It is also a problem that, since the doffing and donning apparatus moves in accordance with a complex control program, which includes a program for preventing collision between the doffing apparatus, the cost of the control system is high.

Another movable type doffing and donning apparatus is disclosed in Japanese Laid-open Patent Application Sho 51-112935. The disclosed apparatus comprises a first bobbin catching means which dons empty bobbins from reservoir means to winding spindles of a spinning machine and a second bobbin catching means which doffs full bobbins from the winding spindles to the reservoir means.

The first and the second bobbin catching means are moved along separate passages, which have a distance therebetween and are vertically parallel to each other, so that the bobbin catching means do not interfere with each other. This movable type doffing and donning apparatus can obviate the problems of loading and unloading bobbins and the weighty apparatus which are inevitable with the doffing and donning apparatus disclosed in the above-mentioned Japanese Published Patent Application Sho 50-10970. This doffing and donning apparatus has the first bobbin catching means and the second bobbin catching means mounted separately from each other on the doffing apparatus with regard to the winding spindles of the spinning machine (in other words, mounted separately from each other in a transverse direction of the apparatus), so that the passages of the full bobbins and the empty bobbins do not interfere with each other. This doffing and donning apparatus can be utilized for doffing full bobbins from and donning empty bobbins on winding spindles of a particular yarn processing machine, such as a cotton spinning machine, which has a sufficiently wide vertical distance between the winding spindles thereof and the reservoir means. However, this doffing and donning apparatus is difficult to utilize for doffing full bobbins from and donning empty bobbins on winding spindles of a yarn processing machine, such as a draw-twister for synthetic yarn, which has a very small vertical distance, compared with the bobbin length, between the winding spindles thereof and the reservoir means. In addition, when a doffed full bobbin or an empty bobbin to be donned is oscillated, the full bobbin or the empty bobbin may touch another empty bobbin or full bobbin and the yarn wound around the full bobbin which is touched by another bobbin may be damaged. To obviate such yarn damage, it is necessary to increase the above-mentioned distance between the winding spindles and the reservoir means and, as a result, the size of the doffing and donning apparatus is increased. In addition, since it is necessary to provide the first and second passages of the first and second yarn catching means separately from each other along the length of the apparatus, the size of the apparatus is also increased.

In some yarn processing machines, such as a draw-twister of a synthetic yarn, since yarn guides, draw rollers and heaters are located at positions over winding spindles, it is difficult to doff full bobbins from the winding spindles along vertical passages and to don empty bobbins on the winding spindles along vertical passages. In this regard, since the doffing and donning apparatus disclosed in the above-mentioned Japanese Laid-open Patent Application Sho. 51-112935 moves full bobbins and empty bobbins along vertical passages, it can not be utilized for the doffing and donning operation for such yarn processing machines. It should be noted, that it is very difficult to vary the vertical passages to other passages, such as curved passages, in the above-mentioned doffing and donning apparatus.

SUMMARY OF THE INVENTION

An object of the present invention is to provide a doffing and donning apparatus whch can obviate the above-mentioned problems and which can be applied for automation of a yarn processing process, such as a draw twisting process of a synthetic yarn in which a plurality of yarn processing machines are disposed parallel to each other, which includes a step for transferring bobbins.

Another object of the present invention is to provide a movable type doffing and donning apparatus which can move along a yarn processing machine, such as a draw-twister, and which can doff full bobbins from winding spindles to a bobbin reservoir means disposed along the winding spindles of the yarn processing machine and having bobbin reservoirs mounted thereon, and which can don empty bobbins from the bobbin reservoir means to the winding spindles, so that the full bobbins are replaced with the empty bobbins.

A further object of the present invention is to provide a movable type doffing and donning apparatus which can be utilized in a conventional yarn processing mill in which the distance between two adjacent yarn processing machines is very narrow.

A still further object of the present invention is to provide an automatic doffing and donning apparatus comprising: a movable frame which is movable along both a yarn processing machine and a bobbin reservoir means disposed along and in front of the yarn processing machine; a full bobbin doffing device mounted on the movable frame for doffing full bobbins formed on winding spindles of the yarn processing machine and transferring them to the bobbin reservoir means; and an empty bobbin donning device mounted on the movable frame, which device is provided with an empty bobbin transfer means which moves the empty bobbins on the bobbin reservoir means to a stand-by position, which position is located above the operating space of the full bobbin doffing device, so that the empty bobbins do not disturb the operation of the full bobbin doffing device, and a bobbin insert means which receives the empty bobbins from the empty bobbin transfer means located at the stand-by position and which inserts them on the winding spindles after the full bobbins are doffed from the winding spindles by the full bobbin doffing device, whereby, the doffing and donning apparatus according to the present invention can be utilized even when the vertical distance between the winding spindles and the bobbin reservoir means is very small.

Another object of the present invention is to provide an automatic doffing and donning apparatus in which empty bobbins moved from a bobbin reservoir means to a stand-by position by means of an empty bobbin transfer means are positioned there in predetermined directions and, then, are received by a bobbin insert means. Consequently, the empty bobbins can be moved along predetermined desirable curved passages without contacting yarn guides, rollers and heaters, and are easily inserted on winding spindles of a yarn processing machine, even when it is difficult to move empty bobbins to the winding spindles along vertical passages.

A further object of the present invention is to provide an automatic doffing and donning apparatus in which empty bobbins are rigidly held at a stand-by position so that the empty bobbins do not touch bobbins doffed from winding spindles.

A still further object of the present invention is to provide an automatic doffing and donning apparatus in which a full bobbin doffing means, which doffs full bobbins, is swingably connected to a transfer means, and the full bobbins are doffed from the winding spindles of a yarn processing machine and inserted on bobbin reservoir means by means of a swinging operation of the bobbin doffing means.

In an embodiment which is illustrated in the accompanying drawings, a bobbin reservoir means is constructed by a series of movable plates which are movable along the yarn processing machine and which can mount both full bobbins and empty bobbins. The total system of this embodiment, including transfer and manual handling systems results in a decrease of manual labor over conventional systems. However, a bobbin reservoir means which has pegs mounted thereon and which can be located in front of the yarn processing machine to be doffed and donned may also be utilized. In an embodiment which is not illustrated, a bobbin reservoir means can be constructed as a pirn truck which is capable of being installed within the doffing and donning apparatus and which can be circulated along a predetermined closed passage.

In another embodiment which is illustrated in the accompanying drawings, since an empty bobbin transfer means of an empty bobbin donning device is constructed by a pair of chains and a bobbin catcher supporting plate supported by the chains, the empty bobbin transfer means can be installed on the doffing and donning apparatus in a space far from the winding spindles. However, the empty bobbin transfer means is not limited to that illustrated in the drawings. The function which must be accomplished the empty bobbin transfer means according to the present invention is to transfer the empty bobbins from the reservoir means to the stand-by position. Therefore, a means, such as a link mechanism, which can effect the above-mentioned function can be utilized instead of the chains. In addition, the empty bobbins transferred to the stand-by position can be reserved at the stand-by position by catching the empty bobbins by means of bobbin catchers.

Furthermore, in a further embodiment which is illustrated in the accompanying drawings, since the bobbin insert means is constructed by swingable levers and a plurality of empty bobbin catchers, the construction of the bobbin insert means can be simple in construction. In another embodiment, which is not illustrated, the bobbin insert means can be constructed as a link mechanism which is capable of insertion of the empty bobbins on the winding spindles of the yarn processing machine.

In another embodiment which is illustrated in the accompanying drawings, since a transfer means of the full bobbin doffing device is constructed as a pair of parallel crank mechanisms consisting of parallel levers and bars, the mechanisms facilitate easy doffing and can be simple in construction. As a result, the mechanism can be installed on the doffing and donning apparatus according to the present invention at the upper rear portion thereof. In addition, in the embodiment which is illustrated, since doffed full bobbins are held by the bobbin catcher and supporters, the full bobbins are stably held, and therefore, the doffing and donning apparatus according to the present invention can be simple in construction.

DETAILED DESCRIPTION OF THE INVENTION

Outline of the Invention

Figure 1:
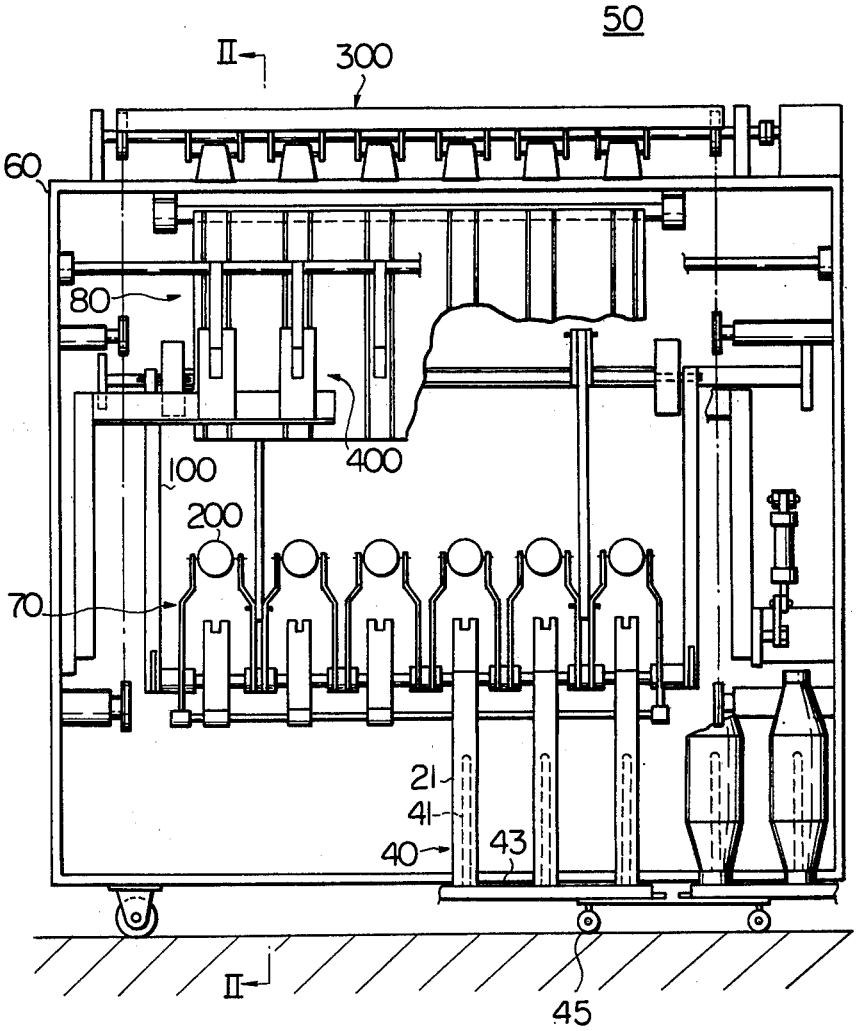
FIG. 1 is an elevational view which illustrates a doffing and donning apparatus according to the present invention.
Figure 2:
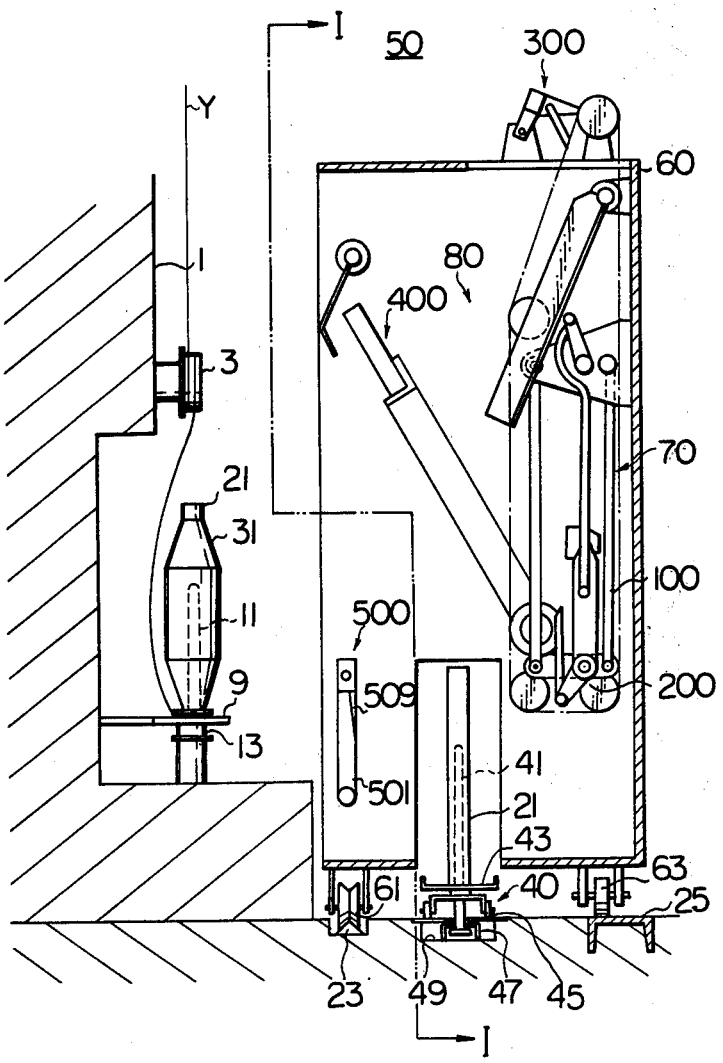
FIG. 2 is a cross sectional view sectioned along the II—II in FIG. 1.

An automatic doffing and donning apparatus according to the present invention, illustrated in FIGS. 1 and 2, is utilized for replacing a plurality of full bobbins 31 which are formed on winding spindles 11 of a yarn processing machine, such as a draw-twister and a spinning machine (in FIG. 2, a draw-twister 1 is illustrated), with a plurality of empty bobbins 21 which are mounted on a bobbin reservoir means 40 disposed along and in front of the winding spindles 11.

Draw-twister

The draw-twister illustrated in FIG. 2 is a well-knwon conventional type of draw-twister. Such a draw-twister is utilized for drawing a synthetic yarn Y, such as an polyester yarn or a nylon yarn, between a yarn supply (not shown) and a draw roller 3 and for winding the yarn Y around a bobbin 21 held on the winding spindle 11 rotatably mounted on a machine frame of the draw-twister 1, for forming a full bobbin 31, so that the yarn Y is twisted by means of the winding spindle 11 and a traverse ring 9.

A plurality of winding bobbins 11 are disposed parallel to each other on the machine frame of the draw-twister 1, in a direction perpendicular to the sheet on which FIG. 2 is illustrated, with a predetermined distance between two adjacent winding spindles 11. The bobbin reservoir means 40 is located in front of the winding spindles 11. The bobbin reservoir means 40 comprises a series of movable plates 43, each adjacent two of which are connected to each other. The plates 43 have wheels 45 mounted below them, so that the plates 43 can be moved along a guide member 47, disposed in a groove 49, in a direction parallel to the winding spindles 11. The plate 43 also has a number of pegs 41 mounted thereon for supporting empty bobbins 21 to be donned on the winding spindle 11 and for supporting full bobbins 31 doffed from the winding spindles 11. The doffed full bobbins 31 are transferred to an unloading position (not shown) by means of the plate 43, as described later in detail, and the empty bobbins 21 are prepared by means of the plates 43.

Doffing and donning apparatus

The doffing and donning apparatus 50 according to the present invention comprises a movable frame 60, which is movable on rails 23 and 25 disposed along both the draw-twister 1 and the bobbin reservoir means 40 by means of wheels 61 and 63 mounted therebeneath. A full bobbin doffing device 70 is mounted on the movable frame 60 and an empty bobbin donning device 80 is mounted on the movable frame 60. The empty bobbin donning device 80 is provided with an empty bobbin transfer means 300 and a bobbin insert means 400. Before the full bobbins 31 completed on the winding spindles 11 are doffed, the movable frame 60 is moved on the rails 23 and 25 along the machine frame 1 and is stopped at a predetermined location. The rails 23 and 25 are disposed along the machine frame of the draw-twister and the rail 23 has a triangular cross section for guiding the frame 60. After the completion of the full bobbins 31, the full bobbin doffing device 70 mounted on the movable frame 60 commences to doff the full bobbins 31 formed on the winding spindles 11, transfers them to the bobbin reservoir means 40 and places them on the pegs 41.

Simultaneously with the operation of the full bobbin doffing device 80, the empty bobbin donning device 70, mounted on the movable frame 60, also performs its donning operation as will now be described. The empty bobbin transfer means 300 moves the empty bobbins 21 on the bobbin reservoir means 40 to a stand-by position, which is located above the operating space of the full bobbin doffing device 70, so that the empty bobbins 21 do not disturb the operation of the full bobbin doffing device 70. The empty bobbins 21 moved from the bobbin reservoir means 40 to the stand-by position by the empty bobbin transfer means 300 are received by the bobbin insert means 400, and transferred to and inserted on the winding spindles 11 by the bobbin insert means 400.

The full bobbin doffing device 70 and the empty bobbin donning device 80 are explained in detail hereinafter with reference to accompanying drawings.

Full bobbin doffing device

The full bobbin doffing device 70 comprises a full bobbin doffing means 200 and a transfer means 100 and is explained with reference to FIGS. 3 through 6.

(Transfer means)

Figure 4:
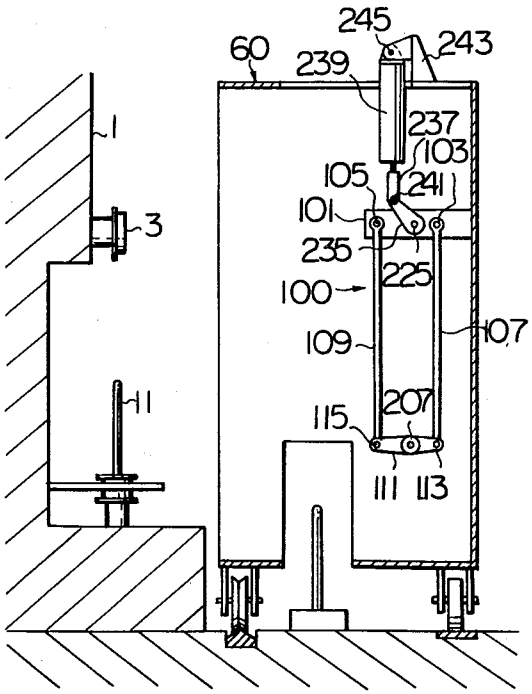
FIG. 4 is a cross sectional view sectioned along line IV—IV in FIG. 3.
Figure 3:
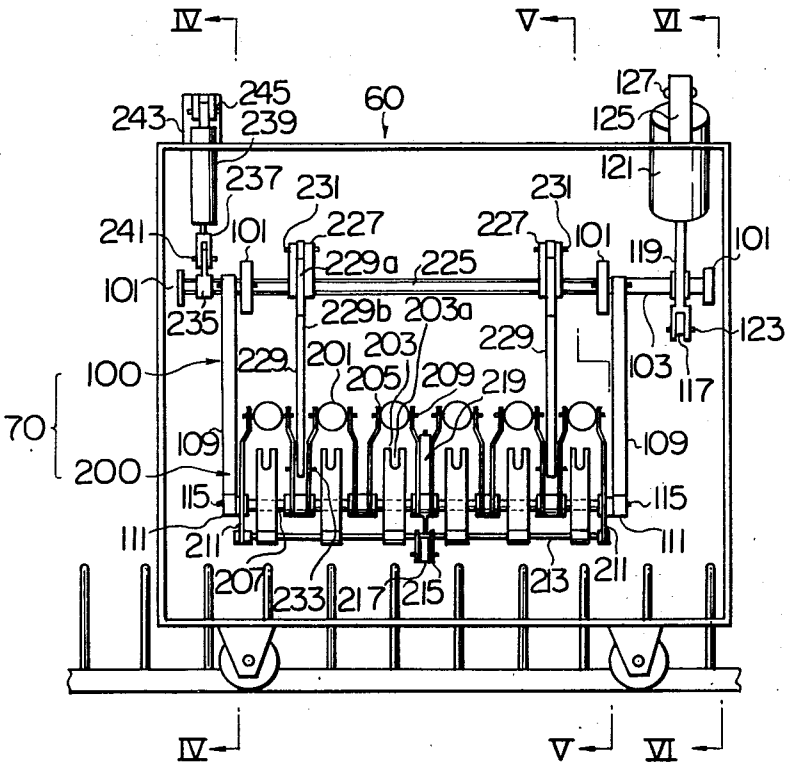
FIG. 3 is an elevational view of a full bobbin doffing device installed in the doffing and donning apparatus illustrated in FIG. 1.
Figure 6:
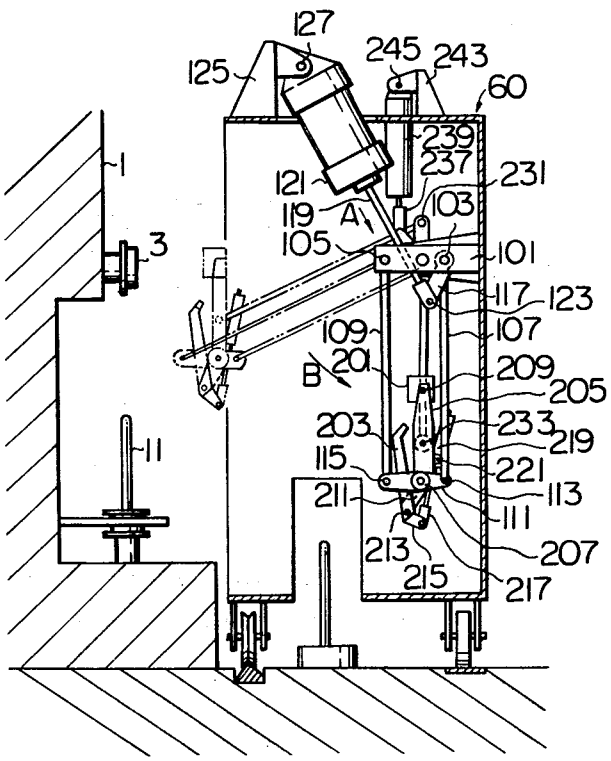
FIG. 6 is a cross sectional view sectioned along VI—VI in FIG. 3.

The movable frame 60 has four brackets 101 which are located in a lengthwise direction of the movable frame 60 (see FIG. 3). The brackets 101 are fixedly mounted on the rear wall of the movable frame 60 and rotatably support a driving shaft 103 via bearings (not shown). Two levers 107, having a predetermined length, are fixed to the driving shaft 103 with a distance in the lengthwise direction therebetween (only one is shown in FIG. 4). Two levers 109, having the same length as the levers 107, are rotatably mounted on the brackets 101 via pins 105 with the same distance in the lengthwise direction therebetween as that between the levers 107. The ends of the levers 107 and 109 are rotatably pivoted to a bar 111 via pins 113 and 115. The distance between the pins 113 and 115 is equal to that between the bearings (not shown) which support the driving shaft 103 and the pin 105. As a result, the levers 107 and 109 and the bar 111 form a parallel crank mechanism (see FIG. 4), and the bar 111 is always located parallel to a line connecting the centers of the driving shaft 103 and the pin 105, as shown by dot-dash line in FIG. 6. The driving shaft 103 has a driving arm 117 (see FIG. 6) fixedly attached thereon, the top end of which is pivoted to a piston rod 119 of a pneumatic cylinder 121 via a pin 123. In FIGS. 3 and 6, the pneumatic cylinder 121 is swingably pivoted to a bracket 125 via a pin 127, which bracket is fixedly mounted on the top of the movable frame 60. Accordingly, when the piston rod 119 is moved forward (arrow A in FIG. 6), the driving arm 117 and the driving shaft 105 are counterclockwisely rotated and the parallel mechanisms, comprising the levers 107 and 109 and bars 111, are swung in a counterclockwise direction designated by arrow B in FIG. 6. On the other hand, when the piston rod 119 is moved backward, the parallel crank mechanisms are swung in a clockwise direction, which is opposite to that designated by the arrow B.

(Bobbin doffing means)

Again referring to FIG. 3, the bobbin doffing means 200 comprises six full bobbin catchers 201, which catch the full bobbins 31 from the winding spindles 11 and which release them to the bobbin reservoir means 40, and six supporters 203 for supporting the full bobbin caught by the bobbin catchers 201. Each of the bobbin catchers 201 is a well-known conventional type of bobbin catcher and is rotatably supported by a pair of arms 205 via pins 209. The arms 205 are fixed to a rotatable supporting shaft 207. The rotatable supporting shaft 207 is rotatably supported by the bars 111 and is located between the bars 111, which bars constitute the above-mentioned parallel crank mechanisms.

Figure 9:
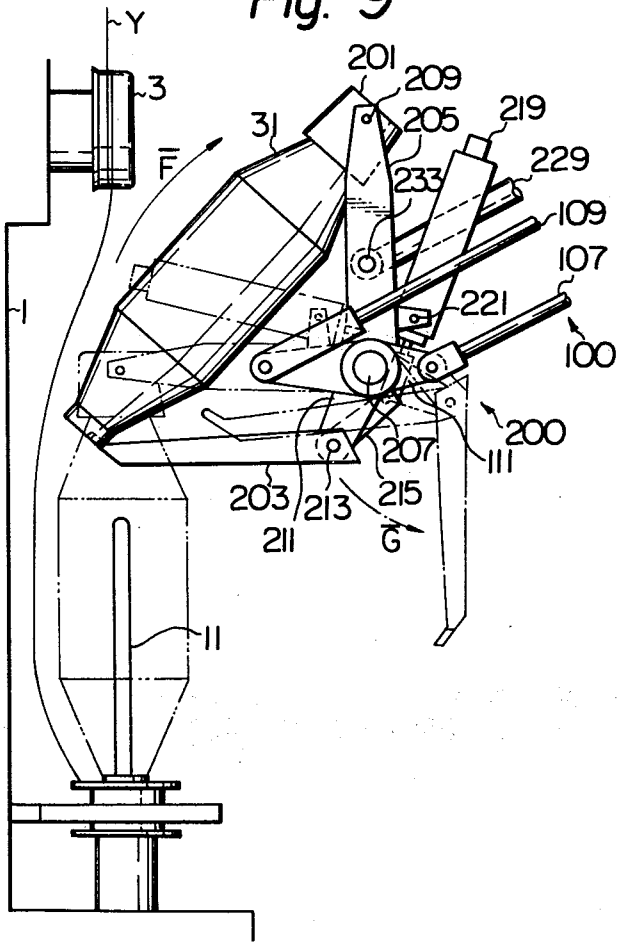
FIG. 9 is an enlarged partial view which illustrates a full bobbin doffing means mounted on the full bobbin doffing device illustrated in FIG. 3.

Two small arms 211 projecting downward are fixed to two ends of the rotatable supporting shaft 207 and have a swing shaft 213 swingably mounted therebetween. The swing shaft 213 has the above-mentioned six supporters 203 fixed thereon, which have notches **203*a* (FIG. 3) for engaging the bobbin surface. The swing shaft 213 has a pair of short levers 215 fixed thereon, at the central portion thereof, which are connected to a piston rod 217 of a small pneumatic cylinder 219. The small pneumatic cylinder 219 is pivoted between two adjacent arms 205 via small brackets 221 (see FIGS. 9 and 10). When the small pneumatic cylinder 219 is moved forward, the supporters 203 move towards the bobbin catchers 201 (arrow G in FIG. 10). On the other hand, when the small pneumatic cylinder 219 is moved backward, the supporters 203 move away from the bobbin catchers 201 (arrow $\overline{G}$ in FIG. 9**).

Figure 5:
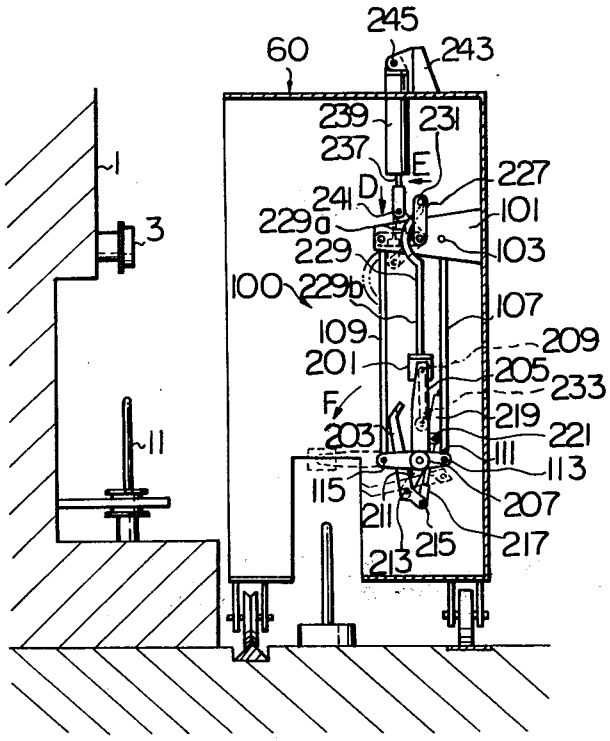
FIG. 5 is a cross sectional view sectioned along V—V in FIG. 3.

The two internal brackets 101 (in FIG. 3) have a swing shaft 225 swingably supported thereon. The swing shaft 225 has two pairs of arms 227 fixed thereon (see FIGS. 3 and 5). The ends of the arms 227 are pivotably connected to connecting rods 229 via pins 231. The connecting rods 229 consist of half circles **229*a* which by-pass the swing shaft 225 and straight rods 229*b* (see FIG. 5). The lower ends of the connecting rods 229 are pivotably connected to two pairs of two adjacent arms 205 via pins 233 (FIG. 3). The swing shaft 225 supported by brackets 101 has a lever 235 fixed thereto (shown at the left end in FIG. 3) which is connected to a piston rod 237 of a pneumatic cylinder 239 via pin 241. The pneumatic cylinder 239 is pivoted via a pin 245 to a bracket 243 fixed to the left top of the movable frame 60. As shown in FIG. 5, the distance between the centers of the pins 233 and 241, both of which are connected to the connecting rods 229, is adjusted to be equal to the length of the levers 107 and 109, constituting a parallel crank mechanism and the line connecting the centers of the pins 233 and 241 is adjusted to be parallel to the levers 107 and 109. As a result, the lever 107 and the connecting rod 229 form another parallel crank mechanism, and when the first distance between the center of the driving shaft 103 and the center of the pin 241 is varied, the second distance between the centers of the pins 113 and 233 is varied, so that the second distance is equal to the first distance. Accordingly, as will be understood from FIG. 5, when the pneumatic cylinder 239 is actuated (arrow D), as shown by dot-dash line in FIG. 5, the pin 241 is swung around the swing shaft 225 (arrow E). Then, the pin 233 is swung around the supporting shaft 207 in a counterclockwise direction (arrow F), and the bobbin catchers 201 and the supporters 203 are also swung around the supporting shaft 207**.

Figure 8:
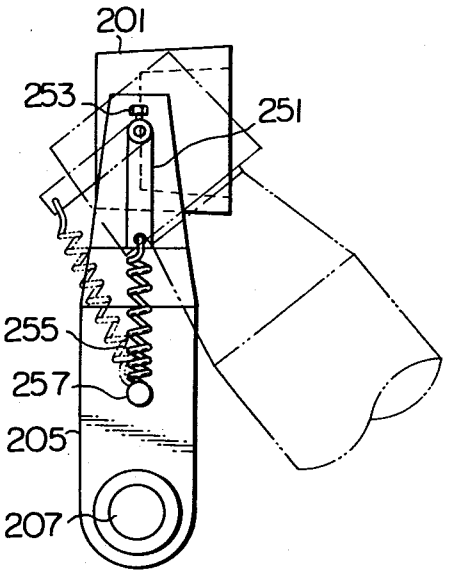
FIG. 8 is a side view of the full bobbin catcher illustrated in FIG. 7.
Figure 7:
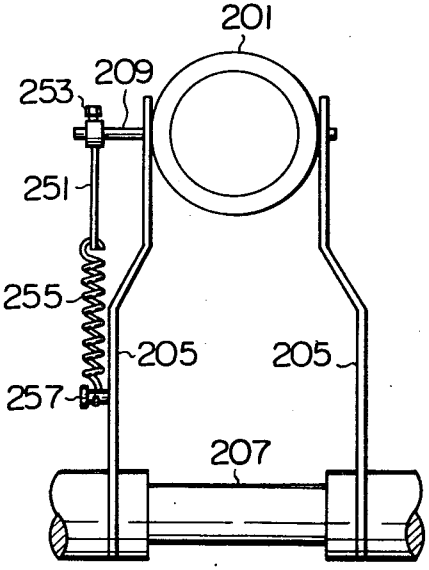
FIG. 7 is a elevational view of a full bobbin catcher which is mounted on the full bobbin doffing device illustrated in FIG. 3.

The constructional relationship between the arms 205 and the bobbin catcher 201 will now be explained in detail with reference to FIGS. 7 and 8. As mentioned above, the bobbin catcher 201 is rotatably supported by one pair of arms 205 via the pins 209 fixed to the bobbin catcher 201. One of the pins 209 has a bar 251 fixed thereon by a screw bolt 253, the end of which bar 251 is urged by a tension spring 255. The end of the spring 255 is connected to a pin 257 fixed to the arm 205. As a result, due to the urging force of the spring 255 the bottom end of the bobbin catcher 203 normally faces a direction perpendicular to the arm 205.

Operation of the full bobbin doffing device

In the ready positions, the bars 111, which constitute the parallel crank mechanisms of the transfer means 100, are normally located at the lowermost position and the arms 205, which constitute the bobbin doffing means 200 mounted on the bars 111, are oriented in the vertical direction. The bobbin catchers 201 pivoted on the arms 205 are oriented in the horizontal direction by means of the tension spring 255, and the supporters 203 are positioned in the proximity of the arms 205.

When the full bobbins mounted on the winding spindles 11 are completed, the pneumatic cylinder 121 (FIGS. 3 and 6) is actuated and the parallel crank mechanisms, comprising the levers 107 and 109, and bars 111, are swung in a clockwise direction (a direction opposite to arrow B in FIG. 6). Then, the bars 111 are horizontally positioned in front of and above the full bobbins mounted on the winding spindles 11 as shown by a dot-dash line in FIG. 6. Since, during this swinging operation of the parallel crank mechanisms, the pins 231, which are connected to the arms 205 by means of the connecting rods 229, are not moved, the locational relationship between the bars 111 and the arms 205 is also maintained constant, in other words the arms 205 are maintained in a vertical position. (see dot-dash line in FIG. 6).

Then, after the bars 111 and the arms 205 are located in front of and above the full bobbins (not shown) formed on the winding spindles 11, the pneumatic cylinder 239, which is connected to the arms 205 through the swing shaft 225, connecting rods 231 and pins 233, is actuated. As a result, the arms 205, which have the bobbin catchers 201 mounted thereon, are swung in a counterclockwise direction and the bobbin catchers 201 cover on the top of the full bobbins 31, as shown by a two dot-dash line in FIG. 9. Then the small pneumatic cylinder 219 is actuated and the supporters 203 are clockwisely swung as designated by a dot-dash arrow $\overline{G}$. After the bobbin catchers 201 catch the full bobbins 31, the pneumatic cylinder 239 is actuated. As a result, the bobbin catchers 201 with the full bobbins 31 are clockwisely swung, as shown by a solid line arrow $\overline{F}$, and the full bobbins 31 are doffed from the winding spindles 11. Due to the weight of the full bobbins 31, the bobbin catchers 201 are swung around the pin 209 against the urging force of the tension spring 255 (FIGS. 7 and 8), and the bottom end of the full bobbins 31 are supported by the supporters 203.

The pneumatic cylinder 121 (FIGS. 3 and 6) is actuated in a direction opposite to the above-mentioned direction and, then, the parallel crank mechanisms comprising the levers 107 and 109, and bars 111, are counterclockwisely swung (in a direction designated by arrow B in FIG. 6). As a result, the doffed full bobbins 31 are located above the peg 41 of the bobbin reservoir means 40, as shown by two dot-dash line in FIG. 10.

Figure 10:
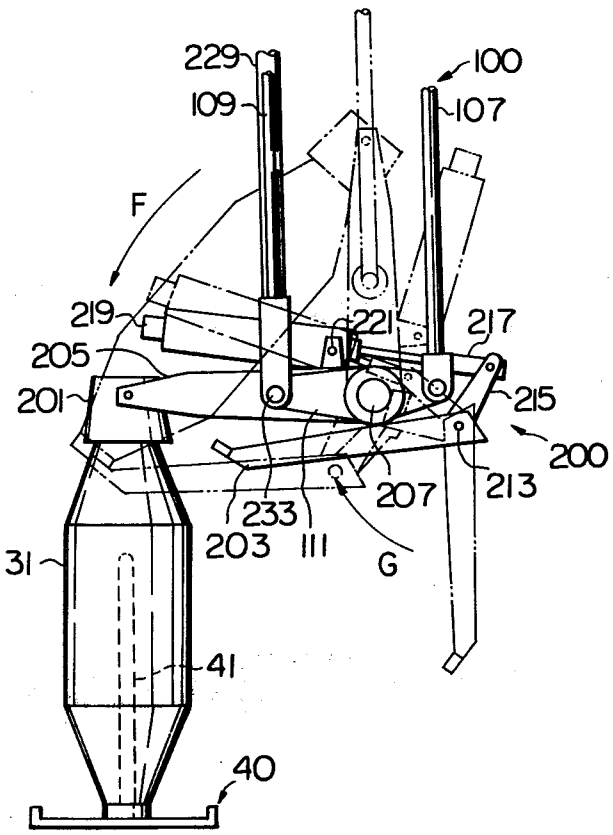
FIG. 10 is an enlarged partial view which illustrates a full bobbin doffing means mounted on the full bobbin doffing device illustrated in FIG. 3.

Then, the pneumatic cylinder 239 (FIGS. 3 and 5) is actuated and the bobbin catchers 201, and the full bobbins 31 caught by the bobbin catchers 201, are swung in a counterclockwise direction as designated by arrow F in FIG. 10. As a result, the full bobbins 31 are inserted on the pegs 41 mounted on the bobbin reservoir means 40. The supporters 203 are moved in a direction designated by arrow G toward the arms 205 by means of the small pneumatic cylinder 219 and the bobbin catchers 205, and the supporters 203, are located as shown by the solid line in FIG. 10. Then the bobbin catchers 201 release the full bobbins 31.

The pneumatic cylinder 239 (FIGS. 3 and 5) is actuated backward and the arms 205 are orientated in a vertical direction. It should be noted that the supporters 203 have been swung around the swing shaft 213, which is located at a position farther from the full bobbin 31 than the supporting shaft 207, before the arms 205 and the supporters 203 are swung around the supporting shaft 207, and that the full bobbins are prevented from being touched and damaged by the swing of the supporters 203.

Empty bobbin donning device

Figures 11, 12:
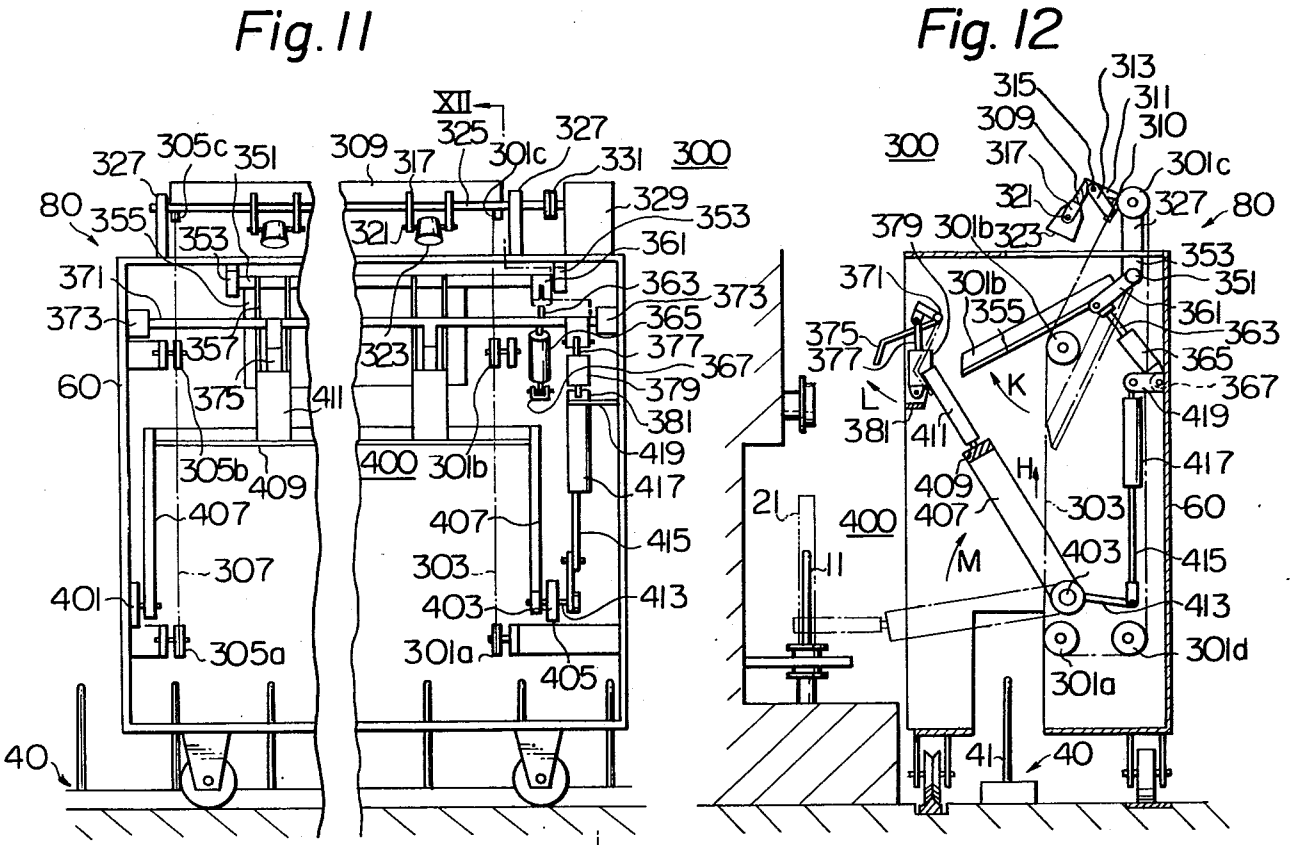
FIG. 11 is an elevational view of an empty bobbin donning device installed in the doffing and donning apparatus illustrated in FIG. 1.
FIG. 12 is a sectional side view sectioned along the line XII—XII in FIG. 11.

With reference to FIGS. 11 and 12, the empty bobbin donning device 80 is mounted on the movable frame 60 and is provided with the empty bobbin transfer means 300 and the bobbin insert means 400. The empty bobbin transfer means 300 moves the empty bobbins (not shown) on the bobbin reservoir means 40 to a stand-by position which is located above the operating space of the full bobbin doffing device 70. The bobbin insert means 400 receives the empty bobbins from the empty bobbin transfer means 300 located at the stand-by position and inserts the empty bobbins 21 on the winding spindle 11.

(Empty bobbin transfer means)

As is illustrated in FIG. 12, four sprockets **301*a*, 301*b*, 301*c* and 301*d* are rotatably supported by the movable frame 60 via brackets (not numbered), and are located at the vertexes of a trapezoid, the parallel lines of which are vertical, and looped chains 303 are suspended by the sprockets 301*a* through 301*d*. Four sprockets 305*a* through 305*d* (FIG. 11, but 305*d* is not shown) are also rotatably supported by the movable frame 60 in a similar constructional manner to the sprockets 301*a* through 301*d* and face the four sprockets 301*a* through 301*d* with a distance therebetween. Looped chains 307 are suspended by the sprockets 305*a* through 305*d*. The sprockets 301*c* and 305*c* are fixed to a chain driving shaft 325 (see FIG. 11) which is rotatably supported by a pair of brackets 327 fastened at the top of the movable frame 60 and which is connected to a driving motor 329 also fastened at the top of the movable frame 60 by means of couplings 331. As a result, when the driving motor 329 (FIG. 11) is driven, in FIG. 12, the chains 303 and 307 move (arrow H) along vertical passages between the sprockets 301***a* and 301*b*, and 305*a* and 305*b*, respectively, and then pass along inclined passages between the sprockets 301*b* and 301*c*, and 305*b* and 305*c*, respectively.

A bobbin catcher supporting plate 309 is supported by the chains 303 and 307 so that the supporting plate 309 extends between the chains 303 and 307. The supporting plate 309 is attached to links 310 of the chains 303 and 307 via brackets 311 and 313 which are connected via pins 315 (FIG. 12). Six bobbin catchers 323, which are of the well known conventional type, are swingably supported by the supporting plate 309 via catcher brackets 317 and pins 321. The distance between two adjacent bobbin catchers is equal to that between the pegs 41 of the bobbin reservoir means 40. As a result, the bobbin catchers 323 catch the empty bobbins 21, and then, the bobbin catchers 323 and the empty bobbins 21 are lifted along vertical passages, and the empty bobbins 21 are withdrawn from the peg 41 of the bobbin reservoir means 40.

A swing shaft 351 is swingably supported by a pair of brackets 353 (FIG. 11) which are fixed to the top of the movable frame 60, shaft 351 and one bracket 353 are shown at the upper right corner in FIG. 12. The swing shaft 351 has a bobbin receiving plate 355 connected thereto, which plate has six pairs of partitions 357 attached thereto. Each pair of partitions 357 form a groove therebetween for holding an empty bobbin 21 therein. The swing shaft 351 also has a swing lever 361 fixed thereon which is pivotable to a piston rod 363 of a pneumatic swing cylinder 365. The pneumatic swing cylinder 365 is pivotably mounted to the end wall of the movable frame 60 via a bracket 367. As a result, due to the operation of the swing cylinder 365 the bobbin receiving plate 355 can move (arrow K in FIG. 12) between a first position (shown by a dot-dash line in FIG. 12), where the bobbin receiving plate 355 is located outside of the passages of the bobbin catchers 323 and does not interfere with the movement of the empty bobbins 21 caught by the bobbin catchers 323, and a second position (shown by a solid line in FIG. 12), where the bobbin receiving plate 355 is located so as to cross to the passages of the bobbin catchers 323 and can receive the empty bobbins 21 from the bobbin catchers 323. The second position is located above the operating space of the above-mentioned full bobbin doffing device 70.

A swing shaft 371 is swingably supported by a pair of bearings 373 which are mounted on the left and right walls of the movable frame 60 in FIG. 11. The swing shaft 371 has six stopper plates 375 which correspond the grooves formed by the pairs of partitions 357 and which have a hooked-shape as shown in FIG. 12. The swing shaft 371 is pivotably connected to a piston rod 377 of a pneumatic cylinder 379. The pneumatic cylinder 379 is pivotably mounted on the movable frame 60 via a bracket 381. As a result, due to the actuation of the pneumatic cylinder 379, the stopper plates 375 can swing (arrow L in FIG. 12) between a first position (shown by a solid line in FIG. 12) where the empty bobbin 21 can freely passed by the stopper plates 375 and a second position (shown by a dot-dash line in FIG. 12) where the stopper plates 375 are located downstream of the bobbin receiving plate 355, which plate is located at the second position thereof.

(Empty bobbin insert means)

In FIG. 11, a bearing 401 is mounted on the lower portion of the left wall of the movable frame 60 and another bearing 403 is mounted on a bracket 405 positioned at the lower right portion of the movable frame 60. The bearings 401 and 403 have a pair of swing arms 407 rotatably supported thereby, the front ends of which arms are connected to each other by a column 409. The column 409 has six empty bobbin catching fingers 411 mounted thereon. A drive shaft 413 is fixedly connected to the swing arm 407 (as illustrated in the lower right portion in FIG. 11) and is pivotably connected to a piston rod 415 of a pneumatic cylinder 417. The pneumatic cylinder 417 is pivoted by a bracket 419 fixed to the movable frame 60. As a result, due to the actuation of the pneumatic cylinder 417, the arms 407 are swung in a direction designated by an arrow M in FIG. 12 and the empty bobbin catching fingers 411 are moved between a first position (shown by a solid line in FIG. 12), where the bobbin catching fingers 411 are located between the receiving plate 355 located at the second position thereof and the stopper plates 375 are located at the second position thereof and catch the empty bobbins 21 located on the receiving plate 355, and a second position (shown by a dot-dash line in FIG. 12), where the empty bobbins 21 caught by the bobbin catching finger 411 are inserted and donned on the winding spindles 11.

Figure 13:
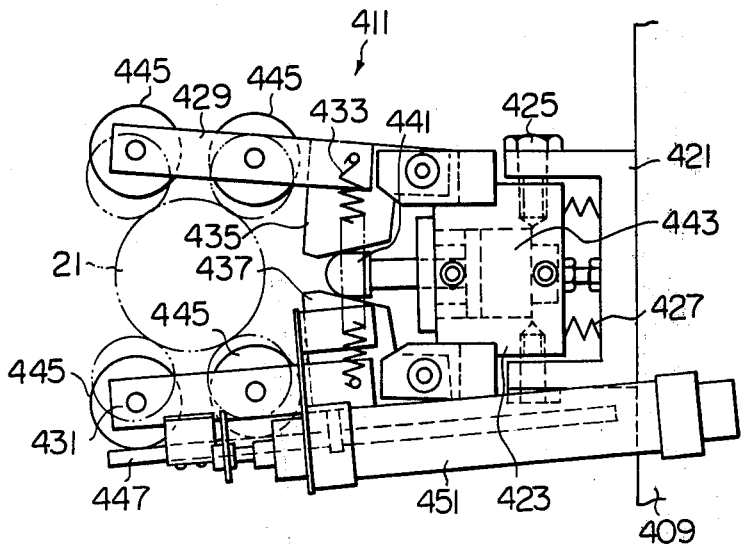
FIG. 13 is a plan view which illustrates an empty bobbin catcher mounted on the empty bobbin donning device illustrated in FIG. 11.

The empty bobbin catching finger 411 will now be explained with reference to FIG. 13. A C-shaped bracket 421 fixed to the column 409 has a cylinder block 423 swingably mounted thereon via pins 425 and urged by tension springs 427. The cylinder block 423 pivotably supports a pair of levers 429 and 431 which are urged toward each other by means of a tension spring 433 and which have inclined plates 435 and 437 fixed thereon. The inclined plates 435 and 437 form a wedge shaped clearance therebetween, through which a cam member 441, having a spherical surface, is moved by means of a cylinder 443 formed within the cylinder block 423. The levers 429 and 431 have a pair of rollers 445, made of a resilient material, rotatably mounted thereon, respectively. One of the rollers 445 is frictionally engaged with a touch member 447 fixed to a piston rod 449 of a pneumatic cylinder 451 attached to the lever 431. When the cam member 441 is moved forward due to the actuation of the cylinder 443, the levers 429 and 431 are moved outward. As a result an empty bobbin 21 can be located at a position surrounded by the rollers 445. Then the cam member 441 is moved backward and the empty bobbin 21 is securedly held by the rollers 445. If the cylinder 451 is actuated, the empty bobbin 21 is rotated around the axis thereof by means of the movement of the touch member 447 and the rotation of the roller 445. Provided that the empty bobbin 21 having a hole (not shown) formed in a polygonal shape at the bottom end thereof is inserted and rotated, the hole is engaged with a projection (not shown) of a corresponding polygonal shape formed at the bottom portion of the winding spindle.

Operation of the empty bobbin donning device

The bobbin catchers 323 are lowered by means of the movement of the chains 303 and 307, in a direction opposite to arrow H in FIG. 12, and grasps the empty bobbins 21 mounted on the pegs 41 of the bobbin reservoir means 40. After the empty bobbins 21 are caught, the bobbin catchers 323 are lifted in the direction of arrow H in FIG. 12. When the bobbin catchers 323 have reached the inclinded passage, the bobbin receiving plate 355 is clockwisely swung, in a direction designated by arrow K, by means of the pneumatic swing cylinder 365, the stopper plate 375 is counterclockwisely swung (in a direction opposite to arrow L in FIG. 12) by means of the pneumatic cylinder 379 and the empty bobbin catching fingers 411 are located at an intermediate position between the receiving plate 355 and the stopper plates 375. The empty bobbins 21 are released from the bobbin catchers 323, slip down to the stopper plates 375 and are held by the empty bobbin catching fingers 411. Then, after the stopper plates 375 are clockwisely swung as shown by arrow L in FIG. 12, the empty bobbin catching fingers 411 are counterclockwisely swung by means of arms 407 (in a direction opposite to arrow M in FIG. 12), the empty bobbins 21 are inserted on the winding spindles 11 and are fixedly fitted on the winding spindle by means of the rotation of the empty bobbins 21 by the bobbin catching fingers 411.

Yarn cutting device

Figure 14:
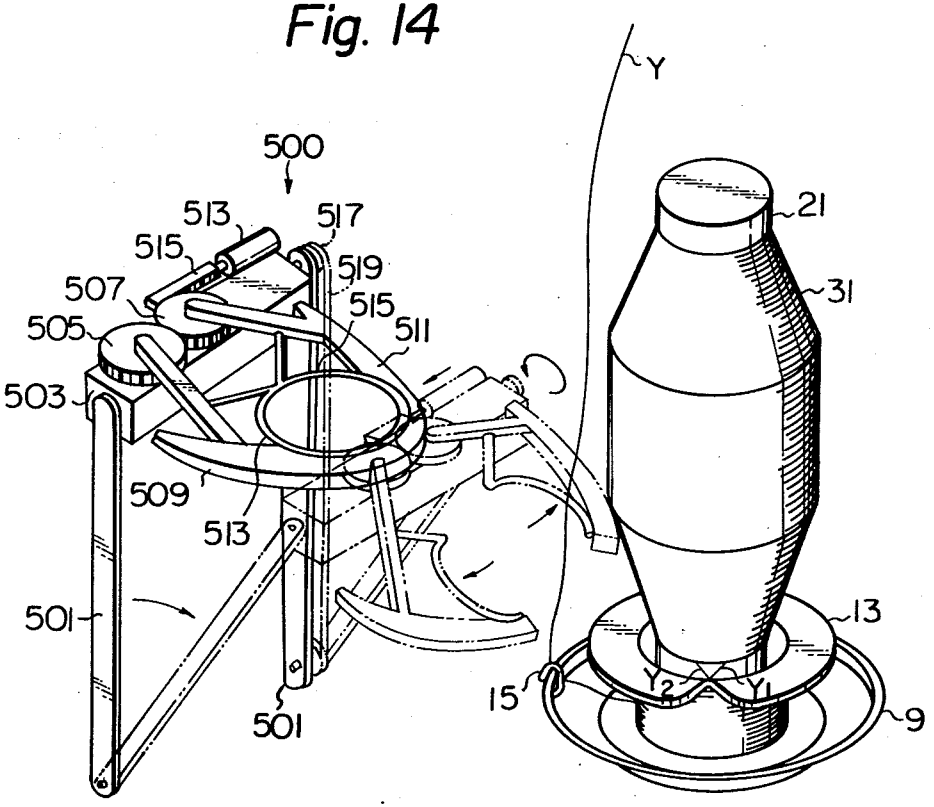
FIG. 14 is a perspective view which illustrates a yarn cutting device which is installed on the doffing and donning apparatus illustrated in FIG. 2.

Referring to FIG. 2, a yarn cutting device 500 is mounted on the movable frame 60 so as to face the winding spindles 11 of the draw-twister 1 and is utilized for cutting yarns which lie between the full bobbin 31 and waste spool 13 mounted on the winding spindle 11 at a position beneath the full bobbin 21. The yarn cutting device 500 will now be explained with reference to FIG. 14. A pair of swing arms 501 are swingably mounted on the movable frame 60 (FIG. 2) and have a housing 503 pivotably mounted therebetween. The housing 503 has a pair of gears 505 and 507 which mesh with each other and which have yarn guides 509 and 511 having a bow shape, and heaters 513 and 515, attached to the inside of the yarn guides 509 and 511. The housing 503 has a pneumatic cylinder 513. The piston rod of the pneumatic cylinder 513 is provided with a rack 515 for engaging with the gear 507. The housing also has a pinion 517 fixed thereon which is engaged with chains 519. When the swing arms 501 are swung, the yarn guides 509 and 511, and heaters 513 and 515, are opened outward by means of the cylinder 513, and the front ends of the yarn guides 509 and 511 are lifted by means of the chains 519 and the pinion 517. The yarn Y extending from the draw roller 3 (FIG. 2) to the waste spool 13 through a traveller 15 is moved aside by one of yarn guides 509 or 511, and the yarn guides 509 and 511 reach the proximity of the full bobbin 31. Then the yarn guides 509 and 511 are closed by means of the cylinder 513. The yarns $Y_1$ and $Y_2$ lying between the full bobbin 31 and the waste spool 13 are thermally cut by the heaters 511 and 513. The yarn cutting device 500 is advantageous in that it results in a reduction of manual labor prior to the doffing operation.

Operation of the automatic doffing and donning apparatus

Figure 15:
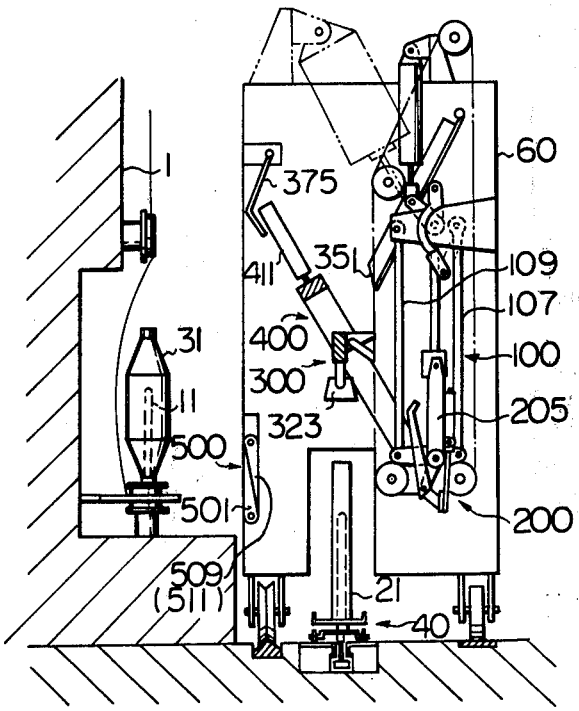
FIGS. 15 through 21 are side views which illustrate, in accordance with time sequence, the operation of the doffing and donning apparatus illustrated in FIG. 1.

The operation of the automatic doffing and donning apparatus, according to the present invention, will now be explained with reference FIGS. 15 through 21. FIG. 15 illustrates the apparatus which is in the ready position just before the commencement of doffing and donning operation. In FIG. 15, the movable frame 60, which has been moved along the draw-twister 1 by means of a moving mechanism (not shown) installed thereon, is located in front of the full bobbins 31 mounted on the winding spindles 11 to be doffed. Bobbin reservoir means 40, having empty bobbins 21 mounted thereon, is located in front of the full bobbins 31. The levers 107 and 109 of the transfer means 100, constituting parallel crank mechanisms, vertically positioned. The arms 205 of the bobbin catching means 200, mounted on the transfer means 100, are also vertically positioned. The bobbin catchers 323 of the empty bobbin transfer means 300 are located above the empty bobbins 21 mounted on the reservoir means 40, and the swing plate 351 and the stopper plates 375 of the empty bobbin transfer means 300 are located at their lower positions. The empty bobbin catchers 411 of the empty bobbin insert means 400 are located upstream of the stopper plate 375. The swing arms 501 and the yarn guides 509 and 511 of the yarn cutting device 500 are positioned vertically.

Figure 16:
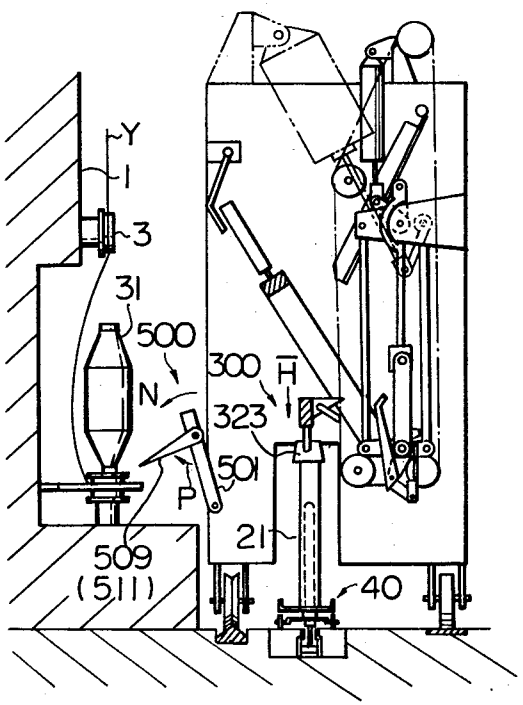

Referring to FIG. 16, the bobbin catchers 323 of the empty bobbin transfer means 300 are lowered (arrow $\overline{H}$) and cover and catch the top of the empty bobbins 21 mounted on the reservoir means 40. At the same time, the swing arms 501 are commenced to swing in a counterclockwise direction (arrow N), and the yarn guides 509 and 511 are commenced to swing in a clockwise direction (arrow P).

Figure 17:
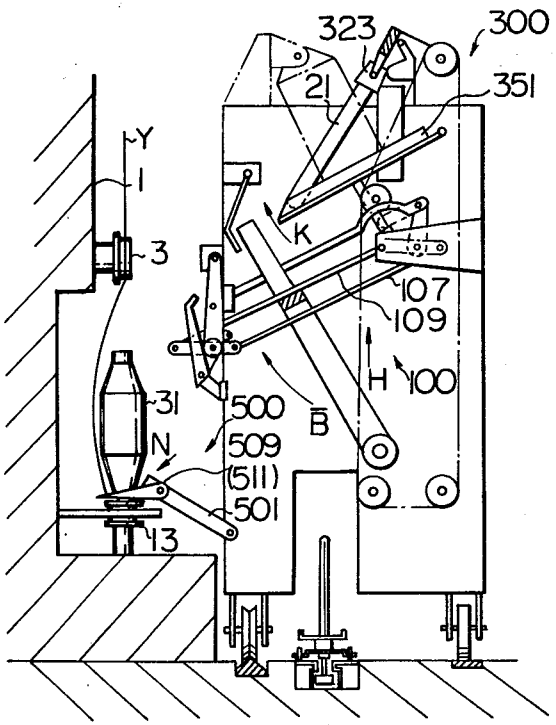

After the empty bobbins 21 are caught by the bobbin catchers 323 of the empty bobbin transfer means 300, the bobbin catchers 323 are moved upward (arrow H) to a position above the swing plate 351 of the empty bobbin transfer means 300 (FIG. 17). Then, the swing plate 351 is clockwisely swung (arrow K), and the levers 107 and 109 of the transfer means 100 are clockwisely swung (arrow $\overline{B}$). Since the empty bobbin 21 caught by the bobbin catchers 323 have been located at their stand-by position, which is above the operating space of the full bobbin doffing device, the swinging operation of the levers 107 and 109, as well as that of the swing plate 351, is not prevented by the bobbin catchers 323. During the above-mentioned operations, the yarn guides 509 and 511 of the yarn cutting device continue their movement and reach a position between the full bobbins 31 and the waste spools 13, both of which are mounted on the winding spindles (not shown in FIG. 17).

The bobbin catchers 201 (FIG. 18) supported by arms 205 of the bobbin catching means 200 are swung in a counter clockwise direction (arrow F) and cover the top of the full bobbins 31. After the top of the full bobbins 31 are caught by the bobbin catchers 201, the supporters 203 are swung in a counterclockwise direction (arrow $\overline{G}$) and positioned away from the full bobbin 31. During the above-mentioned operations, the yarn cutting device cuts the yarns (not shown) lying at spaces between the full bobbins 31 and the waste spools 13, in accordance with the yarn cutting process explained above with reference to FIG. 14.

Figure 19:
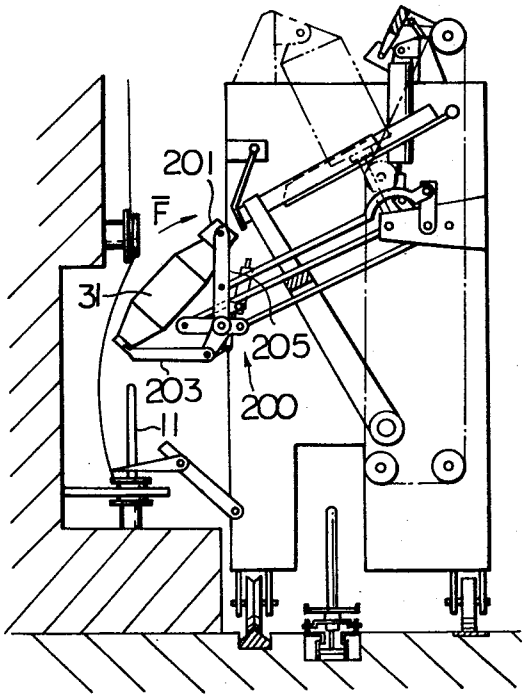
Figure 18:
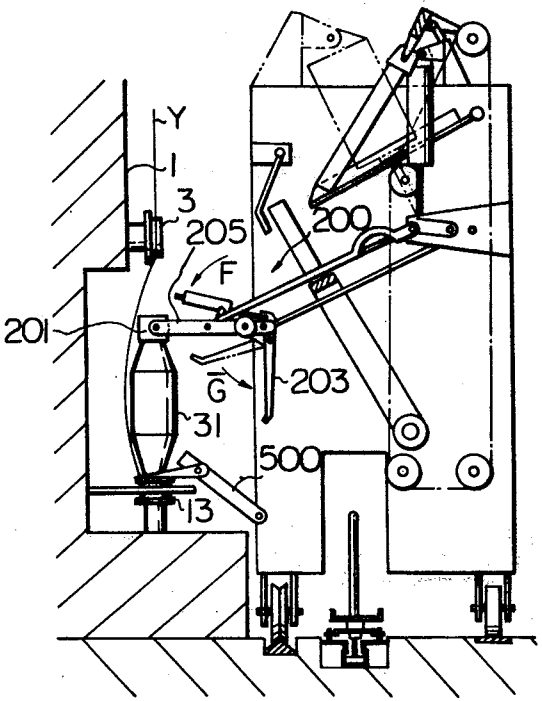

The arms 205 are, as shown in FIG. 19, then swung in a clockwise direction (arrow $\overline{F}$) with the full bobbins 31 caught by the bobbin catchers 201 supported thereon. The full bobbins 31 are doffed from the winding spindles 11 and are supported by the supporters 203.

Figure 20:
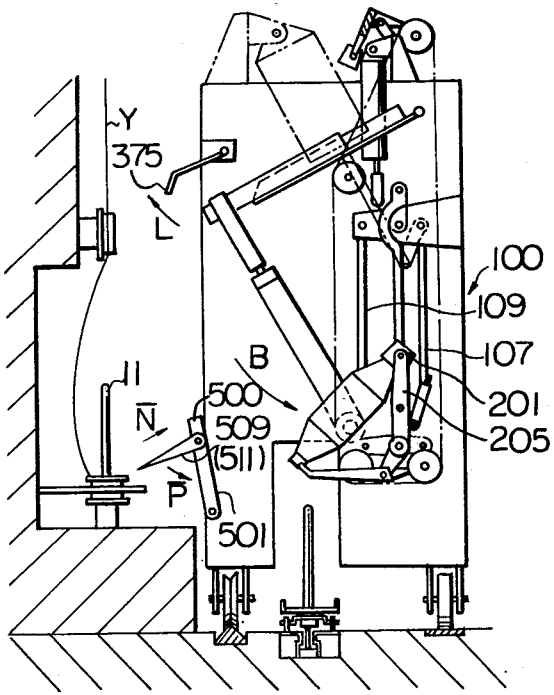

Then, after the levers 107 and 109 of the transfer means 100 are swung counterclockwise (arrow B), as shown in FIG. 20, and after the empty bobbin catching fingers 411 of the empty bobbin insert means 400 catch the empty bobbins 21 therein, the stopper plates 375 of the empty bobbin transfer means 300 are swung in a clockwise direction (arrow L) for permitting the emtpy bobbin catching finger 411 with the emtpy bobbins 21 to pass by the stopper plates 375. During these operations, the arms 501, and yarn guides 509 and 511, commence to return (arrow $\overline{N}$ and $\overline{P}$) to the ready positions thereof.

Figure 21:
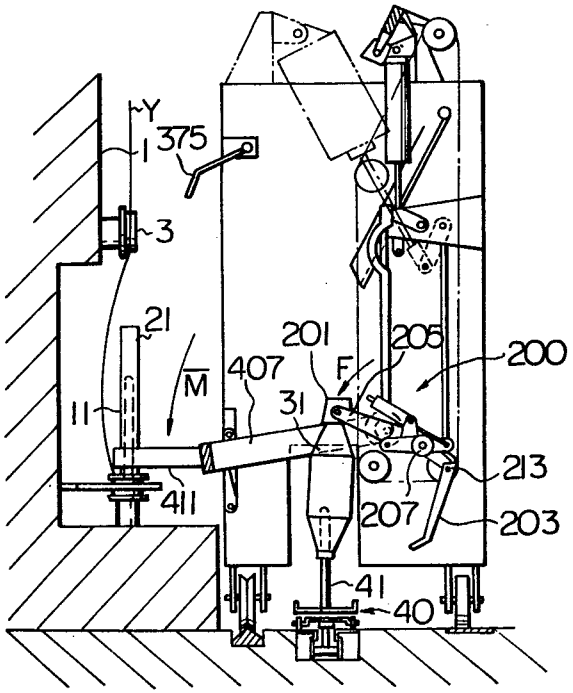

After the full bobbins 31 caught by the bobbin catchers 201, which are supported by the arms 205 of the bobbin catching means 200, are located above the peg 41 of the bobbin reservoir means 40, as shown in FIG. 21, the arms 205 are swung in a counterclockwise direction (arrow F) and the full bobbins 31 caught by the bobbin catchers 201 are inserted on the pegs 41 of the bobbin reservoir means 40 and are released there. At the same time, after the empty bobbin catching fingers 411 of the empty bobbin insert means 400 have grasp the empty bobbins 21, the swing arm 407 is swung in a counterclockwise direction (arrow $\overline{M}$) with the empty bobbins 21. Then the empty bobbins 21 are inserted on the winding spindles 11. After the empty bobbins 21 are inserted on the winding spindles 11, the empty bobbins 21 are rotated around their axes by means of the empty bobbin catching fingers 411, as mentioned above with reference to FIG. 13, and the empty bobbins 21 are engaged with the winding spindles 11.

After the supporters 203 are swung in a clockwise direction around the swing shaft 213, the arms 205 and the supporters 203 are swung in a clockwise direction around the supporting shaft 207, and return to the ready positions thereof. After the swing arms 407 and the empty bobbin catchers 411 are swung in a clockwise direction, the stopper plates 375 are swung in a counterclockwise direction.

After all of the elements of the doffing and donning apparatus according to the present invention are returned to their ready positions, the movable frame is moved to a position immediately before other winding spindles which must be doffed.

As explained in detail above, one doffing and donning apparatus according to the present invention can be utilized for a large number of winding spindles. Consequently, one doffing and donning apparatus can be used for a plurality of draw-twisters. To fully utilize the capability of one doffing and donning apparatus, travelling guide rails for the doffing and donning apparatus can be disposed between the draw-twisters.

Figure 22:
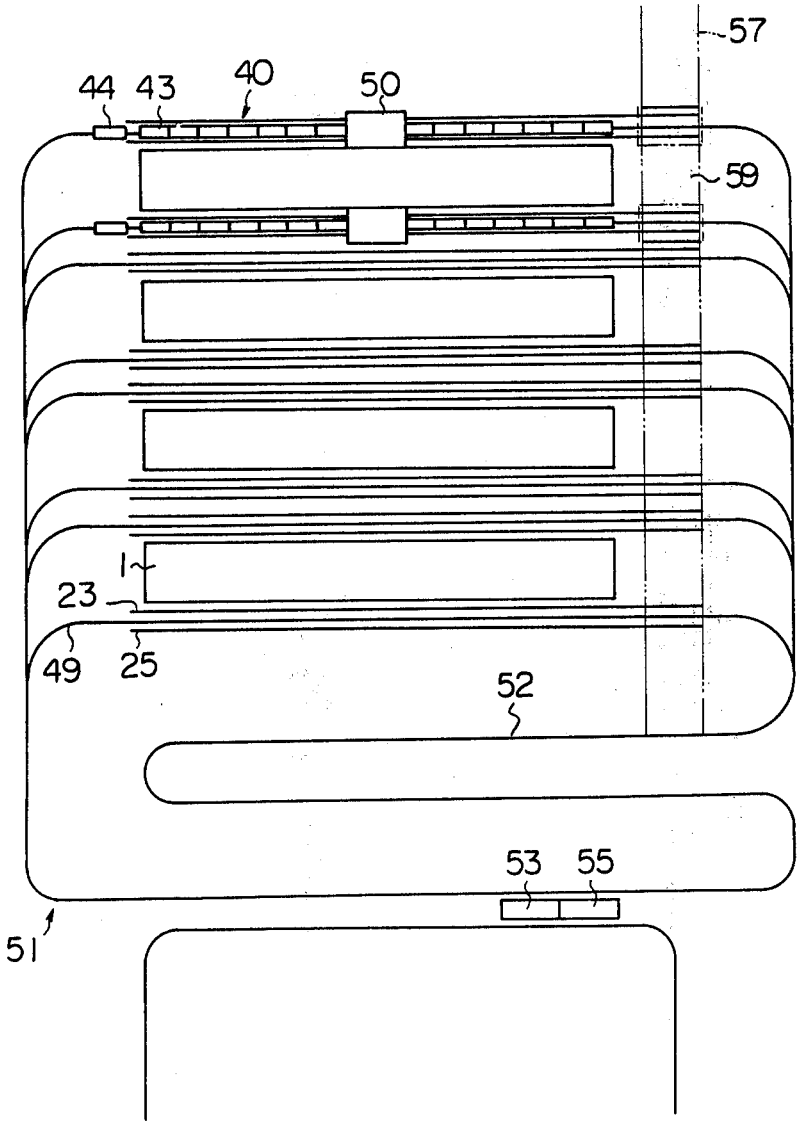
FIG. 22 is a plan view which illustrates a lay-out of a yarn processing mill in which the doffing and donning apparatus of the present invention illustrated in FIG. 1 is installed.
Figure 23:
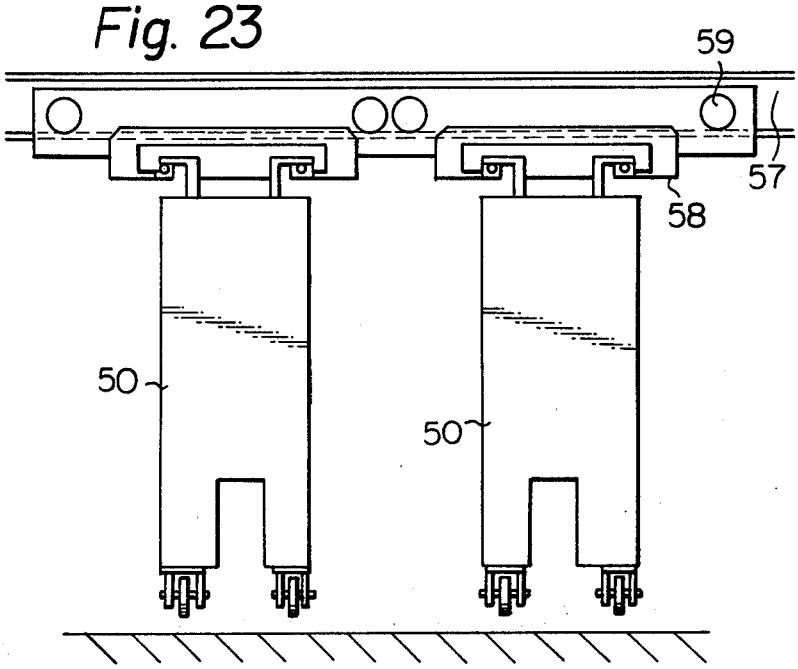
FIG. 23 is an elevational view of a transfer truck.
Figure 24:
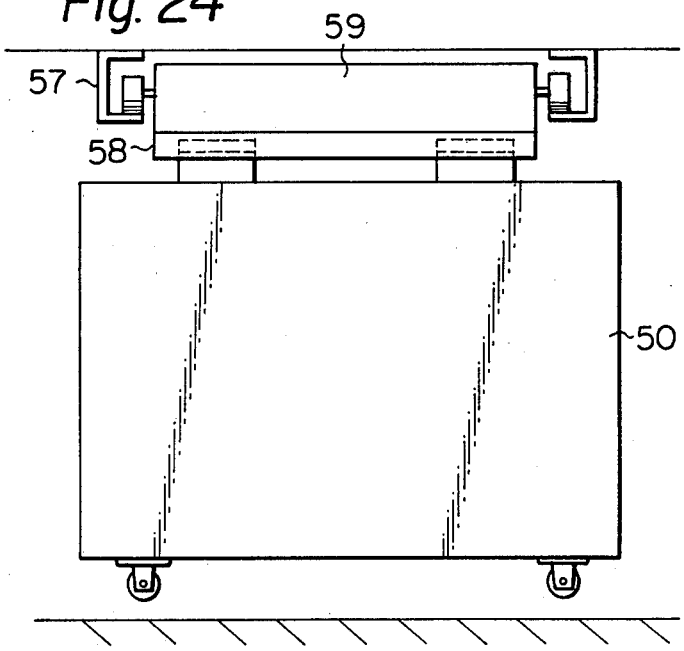
FIG. 24 is a side view of the transfer truck illustrated in FIG. 23.

As illustrated in FIG. 22, a plurality of draw twisters-1 are arranged in several rows. A pair of rails 23 and 25 are disposed along the front of each of the draw-twisters 1, so that the automatic doffing and donning apparatus 50 according to the present invention can be moved along the draw-twister 1. A groove 49 for guiding a plate 43 of the reservoir means 40 is also disposed along the front of the draw-twister 1. A plurality of grooves 49 are gathers together and form a closed loop 51 along which an unloading station 53 for unloading full bobbins 31 from the plates 43 and for supplying them to a subsequent process, and a loading station 55 for loading empty bobbins 21 on the plates 43 are disposed. At one end of each of the rails 23 and 25, a pair of transfer rails 57 is disposed perpendicular to the rails 23 and 25. A transfer truck 59, which is of a hang down monorail type (FIGS. 23 and 24), can be moved along the transfer rails 57. After a head 58 of the transfer truck 59 is lowered to the lower position by means of a lifting gear (not shown) installed on the transfer truck 59, the automatic doffing and donning apparatus 50 are mounted on the head 58 and lifted by means of the lifting gear (not shown).

Referring to FIG. 22, according to a predetermined schedule, a series of plates 43 constituting a reservoir means 40 and having empty bobbins 21 (FIG. 2) mounted thereon are drawn by a tractor 44 and moved from the loading station 55 to a position in front of one of draw-twisters 1 through the looped passage 51. On the other hand, the automatic doffing and donning apparatus 50 unloaded from the transfer truck 59 moves along the rails 23 and 25 and is located at a predetermined position. Referring to FIG. 2, after the full bobbins 31 are formed on the winding spindles 11 of the draw twister-1, the winding spindles 11 are stopped and a full bobbin signal is transmitted from the draw twister-1 to the automatic doffing and donning apparatus 50. When the doffing and donning apparatus 50 receives the full bobbin signal, the doffing and donning apparatus 50 is moved along the rails 23 and 25 and is located at a first position where the doffing and donning apparatus doffs 50 the full bobbins 31 formed on the corresponding winding spindles 11 of the draw twister-1 and dons empty bobbins 21 from the corresponding plates 43 to the corresponding winding spindles 11 of the draw-twister 1. Then, the automatic doffing and donning apparatus 50 is moved to a second position where the doffing and donning operation is repeated. After the doffing and donning operation is completed for all of the winding spindles 11 of the draw twister-1, the doffing and donning apparatus 50 is mounted on the transfer truck 59 and is transferred to another draw twister-1 to be doffed.

On the other hand, in FIG. 22, plates 43 which have full bobbins 31 mounted thereon are again drawn by the tractor 44 and are moved through the looped passage 51 to the unloading station 53, where the full bobbins 31 are unloaded. The plates 43 which are unloaded are loaded with empty bobbins at the loading station 55. The plates 43 having empty bobbins mounted thereon are reserved at a position 52 between the loading station 55 and draw-twisters 1.

What we claim is:

1. An automatic movable doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn processing machine and said bobbin reservoir means;

a full bobbin doffing device mounted on said movable frame for doffing said full bobbins formed on said winding spindles and transferring them to said bobbin reservoir means, and;

an. empty bobbin donning device mounted on said movable frame, which device is provided with;

an empty bobbin transfer means which moves said empty bobbins on said bobbin reservoir means to a stand-by position which is located outside of the operating space of said full bobbin doffing device, so that said empty bobbins do not disturb the operation of said full bobbin doffing device, and a bobbin insert means which receives said empty bobbins from said empty bobbin transfer means located at said stand-by position and which inserts on said winding spindles after said full bobbins are doffed from said winding spindles by said full bobbin doffing device.

2. An automatic doffing and donning apparatus according to claim 1, wherein said empty bobbin trasfer means comprises:

an empty bobbin catching member for catching said empty bobbins mounted on said bobbin reservoir means and for transferring said empty bobbins to said stand-by position, and;

an empty bobbin holding member for holding said empty bobbins which are transferred by said empty bobbin catching member and which are located at said stand-by position until said empty bobbins are received by said bobbin insert means.

3. An automatic doffing and donning apparatus according to claim 2, wherein said empty bobbin catching member comprises:

a plurality of empty bobbin catchers, each of which catches an empty bobbin mounted on said bobbin reservoir means and releases it to said empty bobbin holding member, and;

a lifter for lifting said catchers to said stand-by position.

4. An automatic doffing and donning apparatus according to claim 1, wherein said bobbin insert means comprises:

a plurality of empty bobbin catching fingers which catch said empty bobbins thereon at said stand-by position and release them therefrom to said winding spindles, and;

a pair of swingable arms which are provided with said bobbin catching fingers and which move said bobbin catching fingers between said stand-by position and the proximity of said winding spindles along a circular path.

5. An automatic doffing and donning apparatus according to claim 1, wherein said full bobbin doffing device comprises:

a full bobbin doffing means which doffs said full bobbins from said winding spindles and releases them therefrom to said bobbin reservoir means, and;

a transfer means having said full bobbin doffing means connected thereto for transferring said doffed full bobbins to said bobbin reservoir means.

6. An automatic doffing and donning apparatus according to claim 5, wherein said full bobbin doffing means connected to said transfer means is movable with regard to said transfer means along a predetermined first passage, so that said full bobbins are doffed from said winding spindles and released to said bobbin reservoir means, and is movable with said transfer means along a predetermined second passage which is located between a position above said winding spindles and a position around said reservoir means.

7. An automatic doffing and donning apparatus according to claim 5, wherein said full bobbin doffing means comprises:

a plurality of full bobbin catchers which catch said full bobbins formed on said winding spindles and which release them therefrom to said bobbin reservoir means, and;

a plurality of supporters for supporting said full bobbins caught by said bobbin catchers.

8. An automatic movable doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn processing machine and said bobbin reservoir means;

a full bobbin doffing device mounted on said movable frame for doffing said full bobbins formed on said winding spindles and transferring them to said bobbin reservoir means, which doffing device includes:

a full bobbin doffing means which doffs said full bobbins from said winding spindles and releases them therefrom to said bobbin reservoir means, and;

a transfer means having said full doffing means connected thereto for transferring said doffed full bobbins to said bobbin reservoir means; and, an empty bobbin donning device mounted on said movable frame, which donning device is provided with;

an empty bobbin transfer means which moves said empty bobbins on said bobbin reservoir means to a stand-by position which is located outside of the operating space of said full bobbin doffing device, so that said empty bobbins do not disturb the operation of said full bobbin doffing device, which transfer means includes:

an empty bobbin catching member for catching said empty bobbins mounted on said bobbin reservoir means and for transferring said empty bobbins to said stand-by position, and;

an empty bobbin holding member for holding said empty bobbins which are transferred by said empty bobbin catching member and which are located at said stand-by position, and;

a bobbin insert means which receives said empty bobbins from said empty bobbin catching and holding members of said empty bobbin transfer means located at said stand-by position, and which inserts them on said winding spindles after said full bobbins are doffed from said winding spindles by said full bobbin doffing device, which insert means includes:

a plurality of empty bobbin catching fingers which catch said empty bobbins at said stand-by position and release them to said winding spindles, and;

a pair of swingable arms which have said bobbin catching fingers mounted thereon and which move said bobbin catching fingers between said stand-by position and the proximity of said winding spindles.

9. An automatic doffing and donning apparatus according to claim 1, wherein said movable frame is so constructed and arranged that said movable frame is capable of movement without causing any interference with said bobbin reservoir means, and wherein said movable frame has a driving mechanism for actuating said full bobbin doffing device, said empty bobbin transfer means and said bobbin insert means, which are located at the top or the rear side of said movable frame device, while they are not in operation, and the front portion of said movable frame can be utilized for operation of said apparatus.

10. An automatic movable doffing and donning apparatus according to claim 1, wherein said movable frame is capable of being mounted on a transfer truck which moves in a direction perpendicular to said yarn processing machine at a position outside of said machine.

11. An automatic doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn processing machine and said bobbin reservoir means;

a full bobbin doffing device mounted on said movable frame for doffing said full bobbins formed on said winding spindles and transferring them to said bobbin reservoir means, and;

an empty bobbin donning device mounted on said movable frame, which device is provided with;

an empty bobbin transfer means which moves said empty bobbins on said bobbin reservoir means to a stand-by position which is located above the operating space of said full bobbin doffing device, so that said empty bobbins do not disturb the operation of said full bobbin doffing device, and a bobbin insert means which receives said empty bobbins from said empty bobbin transfer means located at said stand-by position and which inserts them on said winding spindles.

12. An automatic doffing and donning apparatus according to claim 1, which further comprises a yarn cutting device for cutting yarns which lie between said full bobbin and a waste spool mounted on said winding spindle.

13. An automatic doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn processing machine and said bobbin reservoir means;

a full bobbin doffing device mounted on said movable frame for doffing said full bobbins formed on said winding spindles and transferring them to said bobbin reservoir means, and;

an empty bobbin donning device mounted on said movable frame, which device is provided with;

an empty bobbin transfer means which moves said empty bobbins on said bobbin reservoir means to a stand-by position which is located outside of the operating space of said full bobbin doffing device, so that said empty bobbins do not disturb the operation of said full bobbin doffing device, said empty bobbin transfer means comprising:

an empty bobbin catching member for catching said empty bobbins mounted on said bobbin reservoir means and for transferring said empty bobbins to said stand-by position, and an empty bobbin holding menber for holding said empty bobbins which are transferred by said empty bobbin catching member and which are located at said stand-by position until said empty bobbins are received by said bobbin insert means, said empty bobbin holding member comprising:

a swingable plate pivotably supported at said stand-by position for permitting said empty bobbins to pass stand-by position and receive said empty bobbins thereupon from said empty bobbin catching member, and a swingable stopper mounted at said stand-by position for controlling the transfer from said swingable plate to said bobbin insert means; and a bobbin insert means which receives said empty bobbins from said empty bobbin transfer means located at said stand-by position and which inserts on said winding spindles after said full bobbins are doffed from said winding spindles by said full bobbin doffing device.

14. An automatic doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn processing machine and said bobbin reservoir means;

a full bobbin doffing device mounted on said movable frame for doffing said full bobbins formed on said winding spindles and transferring them to said bobbin reservoir means, and;

an empty bobbin donning device mounted on said movable frame, which device is provided with;

an empty bobbin transfer means which moves said empty bobbins on said bobbin reservoir means to a stand-by position which is located outside of the operating space of said full bobbin doffing device, so that said empty bobbins do not disturb the operation of said full bobbin doffing device, and a bobbin insert means which receives said empty bobbins from said empty bobbin transfer means located at said stand-by position and which inserts on said winding spindles after said full bobbins are doffed from said winding spindles by said full bobbin doffing device, said bobbin insert means comprising:

a plurality of empty bobbin catching fingers which catch said empty bobbins thereon at said stand-by position and release them therefrom to said winding spindles, each of said bobbin catching fingers including a plurality of empty bobbin rotating mechanisms disposed at the front end of said swingable arm for rotating said empty bobbins inserted on said winding spindles; and a pair of swingable arms which are provided with said bobbin catching fingers and which move said bobbin catching fingers between said stand-by position and the proximity of said winding spindles along a circular path.

15. An automatic doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn processing machine and said bobbin reservoir means;

a full bobbin doffing device mounted on said movable frame for doffing said full bobbins formed on said winding spindles and transferring them to said bobbin reservoir means, said full bobbin doffing device comprising:

a full bobbin doffing means which doffs said full bobbins from said winding spindles and releases them therefrom to said bobbin reservoir means, and a transfer means having said full bobbin doffing means connected thereto for transferring said doffed full bobbins to said bobbin reservoir means, said full bobbin doffing means connected to said transfer means being movable with regard to said transfer means along a predetermined first passage, so that said full bobbins are doffed from said winding spindles and released to said bobbin reservoir means, and is movable with said transfer means along a predetermined second passage which is located between a position above said winding spindles and a position around said reservoir means, said full bobbin doffing means being swingably pivoted to said transfer means via first pivoting means, so that said first passage is circular around said first pivoting means, and said transfer means being swingably pivoted to said movable frame via a second pivoting means so that said second passage is circular around said second pivoting means;

an empty bobbin donning device mounted on said movable frame, which device is provided with;

an empty bobbin transfer means which moves said empty bobbins on said bobbin reservoir means to a stand-by position which is located outside of the operating space of said full bobbin doffing device, so that said empty bobbins do not disturb the operation of said full bobbin doffing device, and a bobbin insert means which receives said empty bobbins from said empty bobbin transfer means located at said stand-by position and which inserts on said winding spindles after said full bobbins are doffed from said winding spindles by said full bobbin doffing device.

16. An automatic doffing and donning apparatus according to claim 15, wherein said full bobbin transfer means is constructed by a pair of parallel crank mechanisms which are swingably pivoted by a pair of pins and a driving shaft, and which have said full bobbins doffing means pivotably mounted thereon.

17. An automatic doffing and donning apparatus for replacing a plurality of full bobbins, which are mounted on winding spindles disposed parallel to each other on a yarn processing machine, with a plurality of empty bobbins, which are mounted on a bobbin reservoir means disposed along and in front of said winding spindles, wherein said apparatus comprises:

a movable frame which is horizontally movable along both said yarn process machine and said bobbin reservoir means;

a full bobbin doffing device mounted on said movable frame for doffing said full bobbins formed on said winding spindles and transferring them to said bobbin reservoir means, which doffing device includes:

a full bobbin doffing means which doffs said full bobbins from said winding spindles and releases them therefrom to said bobbin reservoir means, said full bobbin doffing means having a plurality of full bobbin catchers which catch said full bobbins formed on said winding spindles and which release them therefrom to said bobbin reservoir means, and a plurality of supporters for supporting said full bobbins caught by said bobbin catchers, a transfer means having said full doffing means connected thereto for transferring said doffed full bobbins to said bobbin reservoir means, said transfer means comprising a pair of parallel crank mechanisms, swingably pivoted by a pair of pins, and having said full bobbin doffing means pivotably mounted thereon, an empty bobbin donning device mounted on said movable frame, which donning device is provided with;

an empty bobbin transfer means which moves said empty bobbins on said bobbin reservoir means to a stand-by position which is located outside of the operating space of said full bobbin doffing device, so that said empty bobbins do not disturb the operation of said full bobbin doffing device, which transfer means includes:

an empty bobbin catching member for catching said empty bobbins mounted on said bobbin reservoir means and for transferring said empty bobbins to said stand-by position, said empty bobbin catching member having a plurality of empty bobbin catchers, each of which catches an empty bobbin mounted on said bobbin reservoir means and releases it to said empty bobbin holding member, and a lifter for lifting said catchers to said stand-by position, an empty bobbin holding member for holding said empty bobbins which are transferred by said empty bobbin catching member and which are located at said stand-by position, said empty bobbin holding member having a swingable plate pivotably supported at said stand-by position for permitting said empty bobbins to pass to said stand-by position and receiving said empty bobbins thereon from said empty bobbin catching member, and a swingable stopper mounted at said stand-by position for controlling the transfer of said empty bobbins from said swingable plate to said bobbin insert means;

a bobbin insert means which receives said empty bobbins from said empty bobbin catching and holding members of said empty bobbin transfer means located at said stand-by position, and which inserts them on said winding spindles after said full bobbins are doffed from said winding spindles by said full bobbin doffing device, said insert means including:

a plurality of empty bobbin catching fingers which catch said empty bobbins at said stand-by position and release them to said winding spindles, and;

a pair of swingable arms which have said bobbin catching fingers mounted thereon and which move said bobbin catching fingers between said stand-by position and the proximity of said winding spindles.

* * * * *

UNITED STATES PATENT AND TRADEMARK OFFICE

CERTIFICATE OF CORRECTION

PATENT NO. : 4,165,585

DATED : August 28, 1979

INVENTOR(S) : Kinyu Ishida, et al

It is certified that error appears in the above—identified patent and that said Letters Patent is hereby corrected as shown below:

Column 15, line 54: "gathers" should be --gathered--.

Column 17, line 4: "trasfer" should be --transfer--.

Column 19, line 3: after "An automatic" insert --movable--.

line 63: "menber" should be --member--.

Signed and Sealed this

*Twenty-fifth* Day of *March 1980*

[SEAL]

*Attest:*

SIDNEY A. DIAMOND

*Attesting Officer*

*Commissioner of Patents and Trademarks*